US012767197B2

(12) United States Patent
Mallampati et al.

(10) Patent No.: US 12,767,197 B2
(45) Date of Patent: Oct. 20, 2026

(54) SYSTEM AND METHOD FOR OPTIMIZING UTILIZATION OF PARKING LOT RESOURCES OF A HUB BASED ON A DUAL-STREAM RESOURCE OPTIMIZATION

(71) Applicant: BNSF Railway Company, Fort Worth, TX (US)

(72) Inventors: Dasaradh R. Mallampati, Trophy Club, TX (US); Vishal Badyal, Haslet, TX (US); Paul Kuhn, Fort Worth, TX (US); April Y Kuo, Colleyville, TX (US)

(73) Assignee: BNSF Railway Company

( * ) Notice: Subject to any disclaimer, the term of this patent is extended or adjusted under 35 U.S.C. 154(b) by 30 days.

(21) Appl. No.: 18/911,387

(22) Filed: Oct. 10, 2024

(65) Prior Publication Data

US 2025/0145191 A1 May 8, 2025

Related U.S. Application Data

(63) Continuation-in-part of application No. 18/501,608, filed on Nov. 3, 2023, now Pat. No. 12,217,199.

(51) Int. Cl.
*B61L 27/16* (2022.01)

(52) U.S. Cl.
CPC ..... *B61L 27/16* (2022.01)

(58) Field of Classification Search
CPC ..... B61L 27/16; B61L 27/12; G06Q 2240/00; G06Q 10/063; G06Q 10/08; G06Q 10/04
See application file for complete search history.

(56) References Cited

U.S. PATENT DOCUMENTS 9,123,239 B2 9/2015 Kurzhanskiy
10,943,318 B2 3/2021 Benedict
(Continued)

FOREIGN PATENT DOCUMENTS

CA 3153593 A1 3/2021
DE 102016219698 A1 4/2018
(Continued)

OTHER PUBLICATIONS

Tomas Liden, Coordinating maintenance windows and train trafc: a case study, Case Study and Applications, Accepted: Feb. 12, 2020 / Published online: Apr. 26, 2020. (Year: 2020).
(Continued)

*Primary Examiner* — Joseph J Dallo
(74) *Attorney, Agent, or Firm* — Enrique Sanchez, Jr.; Juan J Vasquez

(57) ABSTRACT

Systems and techniques for optimizing utilization of parking lots of a hub based on a dual-stream resource optimization (DSRO). In embodiments, an optimized operating schedule over a planning horizon may be obtained, including predictions of units arriving at the hub through a consolidation stream and/or a deconsolidation stream during each time increment of the planning horizon. In embodiments, a unit is received at the hub during a first time increment of the planning horizon of the optimized operating schedule, a dwell time of the unit over the planning horizon ids determined, the unit is classified based on the dwell time of the unit over the planning horizon, and the unit is assigned to a parking lot associated with the hub based on the classification of the unit and a prediction of units to be processed during remaining time increments of the planning horizon after the first time increment.

18 Claims, 5 Drawing Sheets

(56) References Cited

U.S. PATENT DOCUMENTS

| | | | | |
|---|---|---|---|---|
| 11,948,109 | B1 | 4/2024 | Kriett | |
| 12,217,199 | B1 * | 2/2025 | Mallampati | G06Q 10/083 |
| 2002/0082814 | A1 | 6/2002 | Doner | |
| 2002/0082893 | A1 | 6/2002 | Barts et al. | |
| 2004/0034556 | A1 | 2/2004 | Matheson | |
| 2004/0039597 | A1 | 2/2004 | Barts et al. | |
| 2007/0156308 | A1 | 7/2007 | Muinonen | |
| 2014/0089032 | A1 | 3/2014 | Bell | |
| 2014/0236957 | A1 * | 8/2014 | Rieppi | G06Q 10/04 707/741 |
| 2016/0342933 | A1 | 11/2016 | Johnson et al. | |
| 2017/0228566 | A1 | 8/2017 | Sengstaken, Jr. | |
| 2017/0316690 | A1 * | 11/2017 | Charles | H04W 4/023 |
| 2018/0060775 | A1 | 3/2018 | Singhal | |
| 2019/0287066 | A1 | 9/2019 | Kellaway, Jr. et al. | |
| 2020/0065718 | A1 * | 2/2020 | Moore | G06Q 10/02 |
| 2020/0394913 | A1 * | 12/2020 | Reaser | G06Q 50/40 |
| 2021/0150418 | A1 * | 5/2021 | Amrouss | G06Q 10/02 |
| 2021/0272065 | A1 * | 9/2021 | Sakakibara | G06Q 10/04 |
| 2021/0398074 | A1 | 12/2021 | Bollapragada | |
| 2023/0007439 | A1 | 1/2023 | Williams et al. | |
| 2023/0028672 | A1 * | 1/2023 | Oren | B60P 1/43 |
| 2023/0088950 | A1 | 3/2023 | Paula et al. | |
| 2023/0103109 | A1 | 3/2023 | Imazu | |
| 2024/0317285 | A1 | 9/2024 | Malde | |
| 2024/0354635 | A1 | 10/2024 | Davaloo et al. | |
| 2025/0002062 | A1 | 1/2025 | Liu et al. | |
| 2025/0380016 | A1 * | 12/2025 | Allen | G06Q 10/00 |

FOREIGN PATENT DOCUMENTS

| | | | | |
|---|---|---|---|---|
| WO | 2024025863 | A1 | 2/2024 | |
| WO | 2024049818 | A1 | 3/2024 | |
| WO | WO-2024065954 | A1 * | 4/2024 | G06Q 10/02 |

OTHER PUBLICATIONS

Heydari Ruhollah et al: "A path-based capacitated network flow model for empty railcar distribution", Annals of Operations Research, Springer US, New York, vol. 253, No. 2, Sep. 6, 2016 (Sep. 6, 2016), pp. 773-798, XP036260224, ISSN: 0254-5330, DOI: 10.1007/S10479-016-2259-4 [retrieved on Sep. 6, 2016].

Sarosky T et al: "Simulation of a Railroad Intermodal Terminal", Proceedings of the Winter Simulation Conference (WSC). Lake Buena Vista, Dec. 11-14, 1994; [Proceedings of the Winter Simulation Conference (WSC)], New York, IEEE, US, Dec. 11, 1994 (Dec. 11, 1994), pp. 1233-1238, XP000536746, ISBN: 978-0-7803-2109-0.

Natalia Kliewer, Taieb Mellouli, Leena Suhl, A time-space network based exact optimization model for multi-depot bus scheduling, European Journal of Operational Research, vol. 175, Issue 3, 2006 (Year: 2006).

* cited by examiner

SYSTEM AND METHOD FOR OPTIMIZING UTILIZATION OF PARKING LOT RESOURCES OF A HUB BASED ON A DUAL-STREAM RESOURCE OPTIMIZATION

CROSS-REFERENCE TO RELATED APPLICATIONS

The present application is a continuation-in-part of pending and co-owned U.S. patent application Ser. No. 18/501,608, entitled "SYSTEMS AND METHODS FOR INTERMODAL DUAL-STREAM-BASED RESOURCE OPTIMIZATION", filed Nov. 3, 2023, the entirety of which is herein incorporated by reference for all purposes.

TECHNICAL FIELD

The present disclosure relates generally to resource optimization systems, and more particularly to systems and devices for optimizing utilization of parking lot resources of a hub based on a dual-stream resource optimization.

BACKGROUND

The importance of transportation hubs cannot be overstated, as transportation hubs are the lynchpin of logistics, enabling the coordination required for goods to be received, securely stored, systematically sorted, and expediently loaded for delivery. In particular, intermodal hub facilities (IHFs) epitomize this role, functioning as critical junctures where units, typically containers bearing goods, are transitioned between different transportation modes including, but not limited to, rail, road, maritime, and aerial transport. These hubs are characterized by their capabilities to handle and process units that are designed for multi-modal transport, and in this manner serving as integral nodes in transportation networks.

The operational context of an IHF is complex and dynamic. On one side of operations of an IHF, units arriving from customer locales may be in-gated (IG) into the IHF to be processed and then loaded onto trains for delivery to respective destinations. Upon arrival at the respective destinations, units are promptly unloaded and prepared for the final leg of their journey to the customer. On the other side of IHF operations, inbound (IB) units (e.g., units arriving at the IHF via trains carrying the units) are processed for customer delivery at the IHF. This high-volume processing of units, and the specific nature of the IB and IG processes underscores the critical role of IHF resources in handling the influx of IG units received from customers and IB units arriving via trains.

Despite the critical nature of these operations, there are many inefficiencies in current IHF processes, rooted primarily in the management of IHF resources, such as parking lots and parking spaces, which often operate as transient holding areas for units awaiting processing. The competition for parking space allocation between IG and IB units often creates a logistical challenge. IG units, representing the incoming flux of units from customers into the IHF, may require processing for either storage or prompt preparation for onward transit onto an outbound train. In the meantime, while these IG units wait to be loaded onto an outbound train, these units are stored in parking lots of the IHF. Concurrently, IB units, representing the incoming flux of units via inbound trains into the IHF for subsequent pickup by a customer, may require efficient integration into the facility's workflow, ensuring that these units are sorted and dispatched to customers without undue delay. In the meantime, while these IB units wait to be picked up by a customer, these units are stored in parking lots of the IHF.

This balance in the parking lot usage between IG and IB operations is frequently unsettled by the unpredictable nature of IG traffic flows and the variability of customer pickup schedules of IB units, which complicates the already challenging task of parking lot allocation. The resultant coordination between IG and IB units becomes a high-stakes operation, with the potential for even minor misalignments to cause significant logistical setbacks. Adding to the complexity is the fact that not all parking lots within an IHF are created equal. Each possesses distinctive features-specific access points, varied lifting equipment availability, and differing cost structures-all of which must be considered when allocating parking lots and/or spaces to optimize IHF productivity.

Moreover, the nuances of IHF operations extend to temporal and spatial dimensions. The timing of unit arrivals and departures, the ebb and flow of daily and seasonal traffic patterns, and the spatial configuration of parking lots relative to key facility zones, all contribute to the challenges of optimizing IHF operations. Traditional systems and methodologies for managing these aspects are often rigid and lack the adaptability required to respond to real-time changes in IHF dynamics. This lack of flexibility can result in parking lots being allocated to units in a manner that is misaligned with operational needs, thereby creating inefficiencies that ripple throughout the facility's operations.

This inefficient allocation not only wastes valuable parking spaces but also impacts the throughput of the IHF. Delays in unit processing can lead to a cascade of disruptions, from congested docking areas to delayed train departures, all of which cumulatively degrade the IHF's service levels and operational efficiency.

SUMMARY

The present disclosure achieves technical advantages as systems, methods, and computer-readable storage media that provide functionality for optimizing utilization of parking lots of a hub based on a dual-stream resource optimization (DSRO). In embodiments, a parking lot optimization system may be configured to optimize the allocation of parking lots within a hub to maximize the throughput of units though the hub. The parking lot optimization system may achieve the optimization of the allocation of parking lots within the hub by, at least in part, assigning units to parking lots based on the expected dwell time of the units within the hub. For example, the parking lot optimization system 121 may be configured to maximize the throughput of the units within the hub by ensuring that short-dwelling units are assigned to parking spaces that are easily accessible, that medium-dwelling units to are assigned to parking spaces that are somewhat less accessible than the easily accessible parking spaces, and so on, based on the hub parking lots and so on.

In embodiments, the present disclosure provides for a system integrated into a practical application with meaningful limitations as a system with functionality for optimizing utilization of parking lots of a hub based on a DSRO that may include functionality to obtain an optimized operating schedule, which may include a consolidated time-space network, over a planning horizon, representing a consolidation stream of units through the hub (e.g., units arriving or in-gated (IG) into the hub from customers to be loaded into outbound trains) and a deconsolidated time-space network, over the planning horizon, representing a deconsolidation stream of units through the hub (e.g., units arriving to the hub via inbound (IB) trains to be unloaded and delivered customers). The optimized operating schedule may also include a prediction of units to be processed at the hub during each time increment of the planning horizon through each of the consolidation stream and deconsolidation stream. The functionality for optimizing utilization of parking lots of a hub based on a DSRO may also include functionality to receive a unit at the hub during a first time increment of the planning horizon of the optimized operating schedule, to determine a dwell time of the unit over the planning horizon, to classify the unit based on the dwell time of the unit over the planning horizon, and to assign the unit to a parking lot associated with the hub based on the classification of the unit and a prediction of units to be processed during remaining time increments of the planning horizon after the first time increment.

In this manner, the techniques described herein may provide an advantageous result that may allow a system to optimize the management and use of parking lot resources within a hub, to ensure that not only are the parking lot resources being used to assign IG units and IB units to optimum parking lots at the right time during the planning horizon, but also to ensure that the hub productivity level, such as the unit throughput through the hub, is maximized.

Accordingly, the techniques described herein may provide the benefits of allowing a system to plan parking lot utilization and/or allocation for the entire length of a planning horizon and to organize future unit moves within the hub that may be impossible to manage and/or organize manually. As a result, hub throughput maximization is obtained. Units with short dwell times are assigned to most accessible parking lots or parking lot categories (e.g., which may include parking lots that may be near production tracks), while units with long dwell times are assigned to less accessible parking lots or parking lot categories (e.g., which may include parking lots that may be farther away from production tracks). In this manner, long-dwell time units may not displace or prevent short-dwell time units from higher priority (e.g., more accessible) parking lots.

Thus, it will be appreciated that the technological solutions provided herein, and missing from conventional systems, are more than a mere application of a manual process to a computerized environment, but rather include functionality to implement a technical process to replace or supplement current manual solutions or non-existing solutions for optimizing resources in hubs. In doing so, the present disclosure goes well beyond a mere application the manual process to a computer. Accordingly, the claims herein necessarily provide a technological solution that overcomes a technological problem.

In various embodiments, a system may comprise one or more processors interconnected with a memory module, capable of executing machine-readable instructions. These instructions include, but are not limited to, instruction configured to implement the steps outlined in any flow diagram, system diagram, block diagram, and/or process diagram disclosed herein, as well as steps corresponding to a computer program process for implementing any functionality detailed herein, whether or not described with reference to a diagram. However, in typical implementations, implementing features of embodiments of the present disclosure in a computing system may require executing additional program instructions, which may slow down the computing system's performance. To address this problem, the present disclosure includes features that integrate parallel-processing functionality to enhance the solution described herein.

In embodiments, the parallel-processing functionality of systems of embodiments may include executing the machine-readable instructions implementing features of embodiments of the present disclosure by initiating or spawning multiple concurrent computer processes. Each computer process may be configured to execute, process or otherwise handle a designated subset or portion of the machine-readable instructions specific to the disclosure's functionalities. This division of tasks enables parallel processing, multi-processing, and/or multi-threading, allowing multiple operations to be conducted or executed concurrently rather than sequentially. By integrating this parallel-processing functionality into the solution described in the present disclosure, a system markedly increases the overall speed of executing the additional instructions required by the features described herein. This not only mitigates any potential slowdown but also enhances performance beyond traditional systems. Leveraging parallel or concurrent processing substantially reduces the time required to complete sets or subsets of program steps when compared to execution without such processing. This efficiency gain accelerates processing speed and optimizes the use of processor resources, leading to improved performance of the computing system. This enhancement in computational efficiency constitutes a significant technological improvement, as it enhances the functional capabilities of the processors and the system as a whole, representing a practical and tangible technological advancement. The integration of parallel-processing functionality into the features of the present disclosure results in an improvement in the functioning of the one or more processors and/or the computing system, and thus, represents a practical application.

In embodiments, the present disclosure includes techniques for training models (e.g., machine-learning models, artificial intelligence models, algorithmic constructs, etc.) for performing or executing a designated task or a series of tasks (e.g., one or more features of steps or tasks of processes, systems, and/or methods disclosed in the present disclosure). The disclosed techniques provide a systematic approach for the training of such models to enhance performance, accuracy, and efficiency in their respective applications. In embodiments, the techniques for training the models may include collecting a set of data from a database, conditioning the set of data to generate a set of conditioned data, and/or generating a set of training data including the collected set of data and/or the conditioned set of data. In embodiments, that model may undergo a training phase wherein the model may be exposed to the set of training data, such as through an iterative processes of learning in which the model adjusts and optimizes its parameters and algorithms to improve its performance on the designated task or series of tasks. This training phase may configure the model to develop the capability to perform its intended function with a high degree of accuracy and efficiency. In embodiments, the conditioning of the set of data may include modification, transformation, and/or the application of targeted algorithms to prepare the data for training. The conditioning step may be configured to ensure that the set of data is in an optimal state for training the model, resulting in an enhancement of the effectiveness of the model's learning process. These features and techniques not only qualify as patent-eligible features but also introduce substantial improvements to the field of computational modeling. These features are not merely theoretical but represent an integration of a concepts into a practical application that significantly enhance the functionality, reliability, and efficiency of the models developed through these processes.

In embodiments, the present disclosure includes techniques for generating a notification of an event that includes generating an alert that includes information specifying the location of a source of data associated with the event, formatting the alert into data structured according to an information format, and/or transmitting the formatted alert over a network to a device associated with a receiver based upon a destination address and a transmission schedule. In embodiments, receiving the alert enables a connection from the device associated with the receiver to the data source over the network when the device is connected to the source to retrieve the data associated with the event and causes a viewer application (e.g., a graphical user interface (GUI)) to be activated to display the data associated with the event. These features represent patent eligible features, as these features amount to significantly more than an abstract idea. These features, when considered as an ordered combination, amount to significantly more than simply organizing and comparing data. The features address the Internet-centric challenge of alerting a receiver with time sensitive information. This is addressed by transmitting the alert over a network to activate the viewer application, which enables the connection of the device of the receiver to the source over the network to retrieve the data associated with the event. These are meaningful limitations that add more than generally linking the use of an abstract idea (e.g., the general concept of organizing and comparing data) to the Internet, because they solve an Internet-centric problem with a solution that is necessarily rooted in computer technology. These features, when taken as an ordered combination, provide unconventional steps that confine the abstract idea to a particular useful application. Therefore, these features represent patent eligible subject matter.

In embodiments, one or more operations and/or functionality of components described herein can be distributed across a plurality of computing systems (e.g., personal computers (PCs), user devices, servers, processors, etc.), such as by implementing the operations over a plurality of computing systems. This distribution can be configured to facilitate the optimal load balancing of traffic (e.g., requests, responses, notifications, etc.), which can encompass a wide spectrum of network traffic or data transactions. By leveraging a distributed operational framework, a system implemented in accordance with embodiments of the present disclosure can effectively manage and mitigate potential bottlenecks, ensuring equitable processing distribution and preventing any single device from shouldering an excessive burden. This load balancing approach significantly enhances the overall responsiveness and efficiency of the network, markedly reducing the risk of system overload and ensuring continuous operational uptime. The technical advantages of this distributed load balancing can extend beyond mere efficiency improvements. It introduces a higher degree of fault tolerance within the network, where the failure of a single component does not precipitate a systemic collapse, markedly enhancing system reliability. Additionally, this distributed configuration promotes a dynamic scalability feature, enabling the system to adapt to varying levels of demand without necessitating substantial infrastructural modifications. The integration of advanced algorithmic strategies for traffic distribution and resource allocation can further refine the load balancing process, ensuring that computational resources are utilized with optimal efficiency and that data flow is maintained at an optimal pace, regardless of the volume or complexity of the requests being processed. Moreover, the practical application of these disclosed features represents a significant technical improvement over traditional centralized systems. Through the integration of the disclosed technology into existing networks, entities can achieve a superior level of service quality, with minimized latency, increased throughput, and enhanced data integrity. The distributed approach of embodiments can not only bolster the operational capacity of computing networks but can also offer a robust framework for the development of future technologies, underscoring its value as a foundational advancement in the field of network computing.

To aid in the load balancing, the computing system of embodiments of the present disclosure can spawn multiple processes and threads to process data traffic concurrently. The speed and efficiency of the computing system can be greatly improved by instantiating more than one process or thread to implement the claimed functionality. However, one skilled in the art of programming will appreciate that use of a single process or thread can also be utilized and is within the scope of the present disclosure.

It is an object of the disclosure to provide a method of optimizing utilization of parking lots associated with a hub. It is a further object of the disclosure to provide a system for optimizing utilization of parking lots associated with a hub, and a computer-based tool for optimizing utilization of parking lots associated with a hub. These and other objects are provided by the present disclosure, including at least the following embodiments.

In one particular embodiment, a method of optimizing utilization of parking lots associated with a hub is provided. The method includes obtaining an optimized operating schedule including a consolidated time-space network and a deconsolidated time-space network over a planning horizon. In embodiments, the optimized operating schedule includes a prediction of units to be processed at the hub during each time increment of the planning horizon. The method also includes receiving a unit at the hub during a first time increment of the planning horizon of the optimized operating schedule, determining a dwell time of the unit over the planning horizon, classifying the unit based on the dwell time of the unit over the planning horizon, and assigning the unit to a parking lot associated with the hub based on the classification of the unit and a prediction of units to be processed during remaining time increments of the planning horizon after the first time increment.

In another embodiment, a system for optimizing utilization of parking lots associated with a hub is provided. The train yard management system comprises at least one processor and a memory operably coupled to the at least one processor and storing processor-readable code that, when executed by the at least one processor, is configured to perform operations. The operations include obtaining an optimized operating schedule including a consolidated time-space network and a deconsolidated time-space network over a planning horizon. In embodiments, the optimized operating schedule includes a prediction of units to be processed at the hub during each time increment of the planning horizon. The operations also include receiving a unit at the hub during a first time increment of the planning horizon of the optimized operating schedule, determining a dwell time of the unit over the planning horizon, classifying the unit based on the dwell time of the unit over the planning horizon, and assigning the unit to a parking lot associated with the hub based on the classification of the unit and a prediction of units to be processed during remaining time increments of the planning horizon after the first time increment.

In yet another embodiment, a computer-based tool for optimizing utilization of parking lots associated with a hub is provided. The computer-based tool including non-transitory computer readable media having stored thereon computer code which, when executed by a processor, causes a computing device to perform operations. The operations include obtaining an optimized operating schedule including a consolidated time-space network and a deconsolidated time-space network over a planning horizon. In embodiments, the optimized operating schedule includes a prediction of units to be processed at the hub during each time increment of the planning horizon. The operations also include receiving a unit at the hub during a first time increment of the planning horizon of the optimized operating schedule, determining a dwell time of the unit over the planning horizon, classifying the unit based on the dwell time of the unit over the planning horizon, and assigning the unit to a parking lot associated with the hub based on the classification of the unit and a prediction of units to be processed during remaining time increments of the planning horizon after the first time increment.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following descriptions taken in conjunction with the accompanying drawings, in which.

Figure 1:
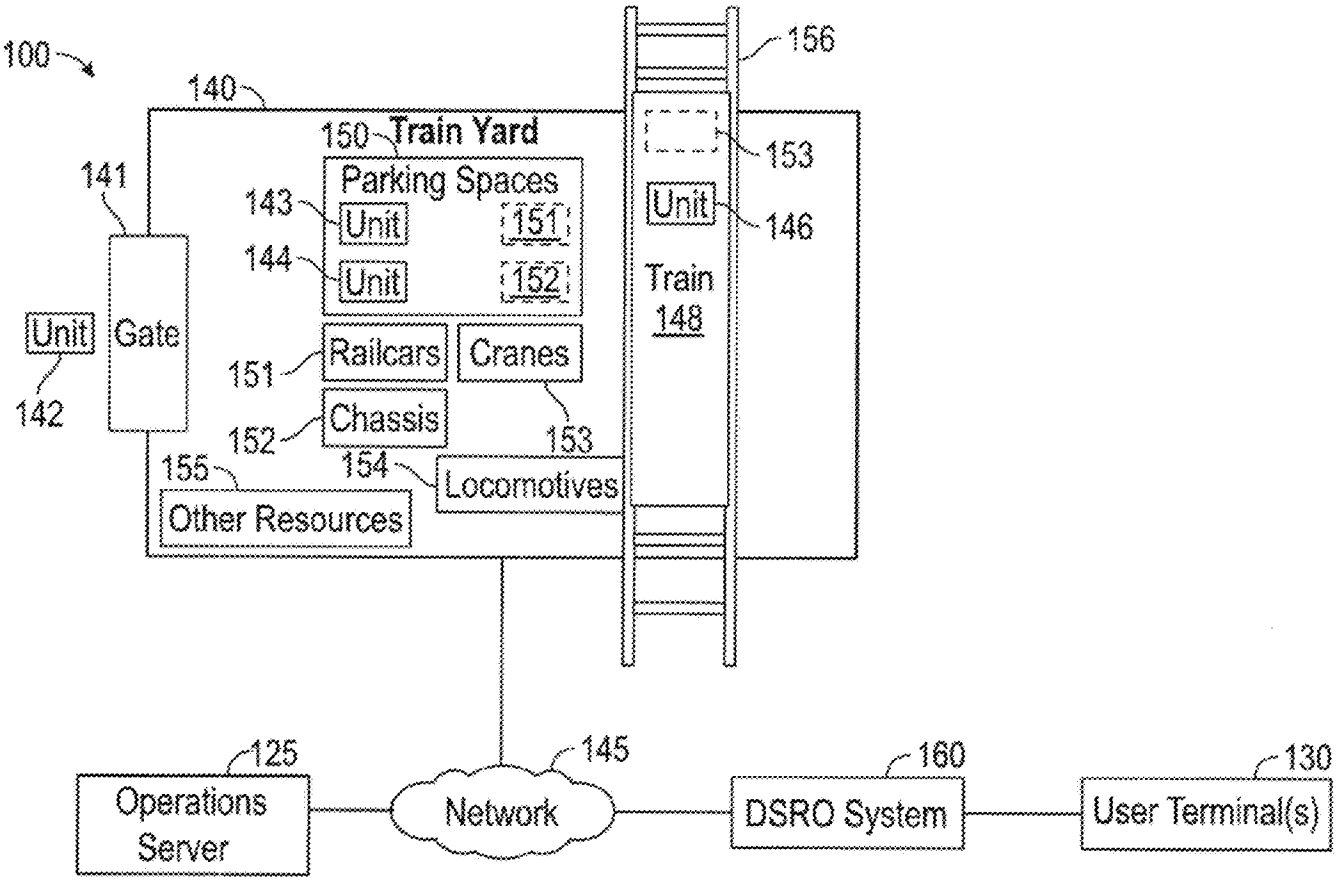
FIG. 1 is a block diagram of an exemplary system configured with capabilities and functionality for optimizing utilization of parking lots of a hub based on a dual-stream resource optimization (DSRO) in accordance with embodiments of the present disclosure.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. The Examiner, after having obtained a thorough understanding of the disclosure and claims of the present application has searched the prior art as disclosed in patents and other published documents, i.e., nonpatent literature. Therefore, the issuance of this patent is evidence that: the elements and limitations presented in the claims are enabled by the specification and drawings, the issued claims are directed toward patent-eligible subject matter, and the prior art fails to disclose or teach the claims as a whole, such that the issued claims of this patent are patentable under the applicable laws and rules of this country.

Various embodiments of the present disclosure are directed to systems and techniques that provide functionality for optimizing utilization of parking lots of a hub based on a dual-stream resource optimization (DSRO). In embodiments, the functionality for optimizing utilization of parking lots of a hub based on a DSRO that may include functionality to obtain an optimized operating schedule, which may include a consolidated time-space network, over a planning horizon, representing a consolidation stream of units through the hub (e.g., units arriving or in-gated (IG) into the hub from customers to be loaded into outbound trains) and a deconsolidated time-space network, over the planning horizon, representing a deconsolidation stream of units through the hub (e.g., units arriving to the hub via inbound (IB) trains to be unloaded and delivered customers). The optimized operating schedule may also include a prediction of units to be processed at the hub during each time increment of the planning horizon through each of the consolidation stream and deconsolidation stream. The functionality for optimizing utilization of parking lots of a hub based on a DSRO may also include functionality to receive a unit at the hub during a first time increment of the planning horizon of the optimized operating schedule, to determine a dwell time of the unit over the planning horizon, to classify the unit based on the dwell time of the unit over the planning horizon, and to assign the unit to a parking lot associated with the hub based on the classification of the unit and a prediction of units to be processed during remaining time increments of the planning horizon after the first time increment.

It is noted that the description that follows focuses on operations of a hub (e.g., an intermodal hub facility (IHF), a train yard, etc.) in which goods or units received from customers are placed on parking lots associated with the hub for eventual loading onto outbound trains to be transported to their respective destinations, and/or received from inbound trains carrying the units or goods that are unloaded and placed onto parking lots associated with the hub for eventual pickup by customers. However, the techniques described herein may be applicable in any application in which parking lots resources may be used in different operations, and where the use of the parkin lot resources may be shared by various processed such that optimization of the use of the parking lot resources may yield a better throughput for the system.

FIG. 1 is a block diagram of an exemplary system 100 configured with capabilities and functionality for optimizing utilization of parking lots of a hub based on a DSRO in accordance with embodiments of the present disclosure. As shown in FIG. 1, system 100 may include user terminal 130, hub 140, network 145, operations server 125, and DSRO system 160. These components, and their individual components, may cooperatively operate to provide functionality in accordance with the discussion herein.

It is noted that the functional blocks, and components thereof, of system 100 of embodiments of the present disclosure may be implemented using processors, electronics devices, hardware devices, electronics components, logical circuits, memories, software codes, firmware codes, etc., or any combination thereof. For example, one or more functional blocks, or some portion thereof, may be implemented as discrete gate or transistor logic, discrete hardware components, or combinations thereof configured to provide logic for performing the functions described herein. Additionally, or alternatively, when implemented in software, one or more of the functional blocks, or some portion thereof, may comprise code segments operable upon a processor to provide logic for performing the functions described herein.

It is also noted that various components of system 100 are illustrated as single and separate components. However, it will be appreciated that each of the various illustrated components may be implemented as a single component (e.g., a single application, server module, etc.), may be functional components of a single component, or the functionality of these various components may be distributed over multiple devices/components. In such embodiments, the functionality of each respective component may be aggregated from the functionality of multiple modules residing in a single, or in multiple devices.

It is further noted that functionalities described with reference to each of the different functional blocks of system 100 described herein is provided for purposes of illustration, rather than by way of limitation and that functionalities described as being provided by different functional blocks may be combined into a single component or may be provided via computing resources disposed in a cloud-based environment accessible over a network, such as one of network 145.

Hub 140 may represent a hub (e.g., an IHF, a train station, etc.) in which units (e.g., containers/trailers carrying goods) are processed as part of the transportation of the unit. For example, the transportation of a unit may include the unit being in-gated (IG) into hub 140 (e.g., by a customer dropping the unit into hub 140). The unit may be temporarily stored in a parking space of parking lots 150, and may eventually be loaded onto an outbound train for transportation to the destination of the unit. On the other side of operations, a unit may arrive via an inbound (IB) train (e.g., the IB train may represent an outbound train from another hub from the which the IB unit may have been loaded), may be unloaded from the IB train, and may be temporarily stored in a parking space of parking lots 150 for eventual pickup by a customer.

Hub 140 may be described functionally by describing the operations of hub 140 as comprising two distinct flows or streams. Units flowing through a first flow (e.g., an IG flow) may be received through gate 141 from various customers for eventual loading onto an appropriate outbound train. For example, customers may drop off individual units (e.g., unit 142) at hub 140. The individual units may be transported by the customers using various chassis (e.g., trucks) that may enter hub 140 through gate 141 carrying the units. The arriving first flow units may be destined for different destinations, and may be dropped off at hub 140 at various times of the day or night. As part of the first flow, the first flow units arriving at hub 140 may be unloaded (e.g., using a crane) from the trucks (or from whatever chassis in which they were transported into hub 140) and may be assigned or allocated to one or more of parking lots 150. The first flow units may eventually be loaded onto an outbound train to be taken to their destination.

For example, unit 142 may be currently being dropped off into hub 140 by a customer, and may be destined to a first destination. In this case, as part of the first flow, unit 142 may be in-gated into hub 140 and may be assigned to a parking space in one of parking lots 150. For example, unit 142 may be assigned to one of parking lot 151 or parking lot 152, in accordance with functionality of system 100 for optimizing utilization of parking lots as described herein. In this same example, unit 143 may have been previously dropped off into hub 140 by a customer (e.g., the same customer or a different customer) to be transported to some destination (e.g., the first destination or a different destination), and may have previously been assigned to a parking lot of parking lots 150. In this example, train 148 may be bound to the first destination. In this case, unit 142, as part of the first flow, may eventually be loaded onto train 148. As can be seen, currently, train 148 may have a space 153 available to receive unit 142. Unit 143 may also be loaded onto train 148 as part of the first flow when unit 143 is destined for the first destination. As part of the first flow, unit 142 (and unit 143 when destined for the first destination) may eventually leave hub 140 onboard train 148 when train 148 departs to the first destination. In this manner, the first flow may operate to receive various units from various customers and consolidate them into departing trains based on the destination of the units to be transported to their respective destinations.

Units flowing through a second flow (e.g., an IB flow) may arrive at hub 140 via an IB train (e.g., train 148 over railroad 156) carrying the second flow units and may eventually be unloaded from the arriving train to be made available for delivery to (e.g., for pickup by) customers. For example, units 144 and 146 may arrive from a source location at hub 140 via train 148 over railroad 156) carrying these and in some embodiments many other units. The second flow units arriving at hub 140 may be consigned to different and/or various customers. For example, units 144 and 146 may be consigned to one or more customers. After arrival via train 148, the second flow units may be unloaded (e.g., using a crane) from train 148 and may be assigned to be stored in spaces of one or more of parking lots 150. For example, unit 144 may be unloaded from train 148 and may be stored in a parking lot of parking lots 150. Unit 146 may also be eventually unloaded from train 148 and may be assigned to an available space of a parking lot (e.g., parking lot 151 or parking lot 152) of parking lots 150. The unloaded second flow units may eventually be picked up by respective customers and may exit or leave hub 140. In this manner, the second flow may operate to receive a train carrying various units, to deconsolidate the train into the various units, and to make the units available for delivery to the respective customers.

In embodiments, processing the units through the first flow and the second flow may involve the use of a wide variety of resources to consolidate the units from customers into departing trains and/or to deconsolidate arriving trains into units for delivery to customers. These resources may include hub personnel (hostler drivers, crane operators, etc.), parking spaces, chassis, hostlers, cranes, tracks, railcars, locomotives, etc. These resources may be used to facilitate holding and/or moving the units through the operations of the hub. For example, parking lots 150 may be used to park or store units while the units are waiting to be loaded onto departing trains or waiting to be picked up by customers. Chassis 152 (e.g., including hostlers, trucks, forklifts, etc.), and operators of chassis 152, may be used to move units within hub 140, such as moving unloaded units from arriving trains to parking lots 150, and/or to move units from parking spaces 152 to departing trains, as necessary. Cranes 153 may be used to load units onto departing trains (e.g., to unload units from chassis 152 and load the units onto the departing trains), and/or to unload units from arriving trains (e.g., e.g., to unload units from arriving trains and load the units onto chassis 152). Railcars 151 may be used to transport the units in the train. For example, a train may be composed of one or more railcars, and the units may be loaded onto the railcars for transportation. Arriving trains may include one or more railcars including units that may be processed through the second flow, and departing trains may include one or more railcars including units that may have been processed through the first flow. Railcars 151 may be assembled together to form a train. Locomotives 154 may include engines that may be used to power a train. Other resources 155 may include other resources not explicitly mentioned herein but configured to allow or facilitate units to be processed through the first flow and/or the second flow.

In embodiments, the first and second flows may, in some situations, compete for the hub resources, and, in other situation, may complement each other in the use of the resources. For example, parking lots including parking spaces may be used to park or stored units being processed through the first flow (e.g., the IG flow) while these IG units are waiting to be loaded onto an outbound train. However, parking lots including parking spaces may also be used to park or store units processed through the second flow (e.g., the IB flow) while these IB units are waiting to be picked up by a customer. In this manner, the IG flow and the IB flow of the hub operations may compete for the use of parking lots within the hub.

User terminal 130 may include a mobile device, a smartphone, a tablet computing device, a personal computing device, a laptop computing device, a desktop computing device, a computer system of a vehicle, a personal digital assistant (PDA), a smart watch, another type of wired and/or wireless computing device, or any part thereof. In embodiments, user terminal 130 may provide a user interface that may be configured to provide an interface (e.g., a graphical user interface (GUI)) structured to facilitate an operator interacting with system 100, e.g., via network 145, to execute and leverage the features provided by server 110. In embodiments, the operator may be enabled, e.g., through the functionality of user terminal 130, to provide configuration parameters that may be used by system 100 to provide functionality for managing operations of hub 140 in accordance with embodiments of the present disclosure. In embodiments, user terminal 130 may be configured to communicate with other components of system 100.

In embodiments, network 145 may facilitate communications between the various components of system 100 (e.g., hub 140, DSRO system 160, and/or user terminal 130). Network 145 may include a wired network, a wireless communication network, a cellular network, a cable transmission system, a Local Area Network (LAN), a Wireless LAN (WLAN), a Metropolitan Area Network (MAN), a Wide Area Network (WAN), the Internet, the Public Switched Telephone Network (PSTN), etc.

In embodiments, operations server 125 may be configured to provide functionality for facilitating operations of hub 140. In embodiments, operations server 125 may include data and information related to operations of hub 140, such as current inventory of all hub resources (e.g., hostlers, drivers, lift capacity, parking lot and parking spaces, IG capacity limits, railcar, locomotives, tracks, etc.). This hub resource information included in operations server 125 may change over time as resources are consumed, replaced, and/or replenished, and operations server 125 may have functionality to update the information. Operations server 125 may include data and information related to inbound and/or outbound train schedules (e.g., arriving times, departure times, destinations, origins, capacity, available spots, inventory list of units arriving in inbound trains, etc.). In particular, inbound train schedules may provide information related to inbound trains that are scheduled to arrive at the hub during the planning horizon, which may include scheduled arrival time, origin of the inbound train, capacity of the inbound train, a list of units loaded onto the inbound train, a list of units in the inbound train destined for the hub (e.g., to be dropped off at the hub), etc. With respect to outbound train schedules, the outbound train schedules may provide information related to outbound trains that are scheduled to depart from the hub during the planning horizon, including scheduled departure time, capacity of the outbound train, a list of units already scheduled to be loaded onto the outbound train, destination of the outbound train, etc. In embodiment, the information from operations server 125 may be used (e.g., by DSRO system 160) to develop and/or update an optimized operating schedule based on a DSRO for managing the resources of hub 140 over a planning horizon.

In embodiments, operations server 125 may provide functionality to manage the execution of the operational schedule (e.g., an optimized operating schedule in accordance with embodiments of the present disclosure) over the planning horizon of the operating schedule. The optimized operating schedule may represent recommendations made by DSRO system 160 of how units arriving at each time increment of the planning horizon are to be processed, and how resources of hub 140 are to be managed to maximize unit throughput through the hub over the planning horizon of the optimized operating schedule. Particular to the present disclosure, the optimized operating schedule may include recommendations associated with the utilization of parking lot (e.g., associated with parking lot allocations) for units arriving to the hub at each time increment of the planning horizon. In embodiments, operations server 125 may manage execution of the optimized operational schedule by monitoring consolidation stream operations flow 116 (e.g., the actual traffic flow through the consolidation stream 115 during execution of the optimized operating schedule) and deconsolidation stream operations flow 118 (e.g., the actual traffic flow through the deconsolidation stream 117 during execution of the optimized operating schedule) to ensure that the optimized operational schedule is being executed properly, and to update the optimized operating schedule based on the actual unit traffic, which may impact resource availability and/or consumption, especially when the actual unit traffic during execution of the optimized operational schedule differs from the predicted unit traffic used in the generation of the optimized operational schedule.

In embodiments, operations server 125 may operate to provide functionality that may be leveraged during execution of the optimized operational schedule over a planning horizon to ensure that unit throughput through the hub is maximized over the planning horizon. This functionality of operations server 125 may include functionality to allocate parking lots to arriving units (e.g., arriving through the IG and/or IG flows) in accordance and/or based on the optimized operating schedule over the planning horizon. In embodiments, operations server 125 may include functionality to ensure that the optimized operating schedule is updated based on actual operations, such as based on actual resource consumption (e.g., based on actual units arriving, the type of units arriving such as short-dwell, medium dwell, long-dwell, etc.).

DSRO system 160 may be configured to manage resources of hub 140 based on a DSRO to maximize throughput through hub 140 in accordance with embodiments of the present disclosure. In particular, DSRO system 160 may be configured to provide the main functionality of system 100 to optimize the utilization of parking lots 150 of hub 140 based on a DSRO such that parking lots of parking lots 150 are allocated to units arriving to hub 140 (e.g., through the IG flow and/or the IB flow) in a manner to ensure that unit throughput through the hub is maximized over the planning horizon of the optimized operating schedule. As mentioned above, the optimized operating schedule may represent recommendations by DSRO system 160 of how units arriving at each time increment of the planning horizon are to be processed, and/or how resources of hub 140 are to be managed to maximize unit throughput through the hub over the planning horizon of the optimized operating schedule. Particular to the present disclosure, the optimized operating schedule may include recommendations associated with the utilization of parking lot resources (e.g., associated with parking lot allocations) for units arriving to the hub at each time increment of the planning horizon. For example, the optimized operating schedule may include recommendations of which parking lots to allocate units arriving at each time increment of the planning horizon based on a classification of the units, as will be described in more detail below.

In embodiments, DSRO system 160 may optimize the utilization of parking lot resources of hub 140 over the planning horizon of an optimized operating schedule by leveraging the functionality of a parking lot optimization system (e.g., parking lot optimization system 121) that may include functionality to synchronize the operations of the first flow (e.g., the IG flow) and the second flow (e.g., the IB flow) to maximize the throughput of hub 140 by optimizing the allocation of parking lots and parking spaces to units processed through each of the flows over the planning horizon based on a classification of the arriving units. In particular, DSRO system 160 may be configured to represent the first and second flows as a time-expanded network (e.g., of a DSRO model) to model the unit flows and dwell times through hub 140 over a planning horizon, and to apply the DSRO model to generate an optimized operating schedule over the planning horizon that may achieve maximum unit flow through hub 140 over the planning horizon. The parking lot optimization system of DSRO system 160 may optimize the allocation of parking lots to units over the entire planning horizon.

Figure 2:
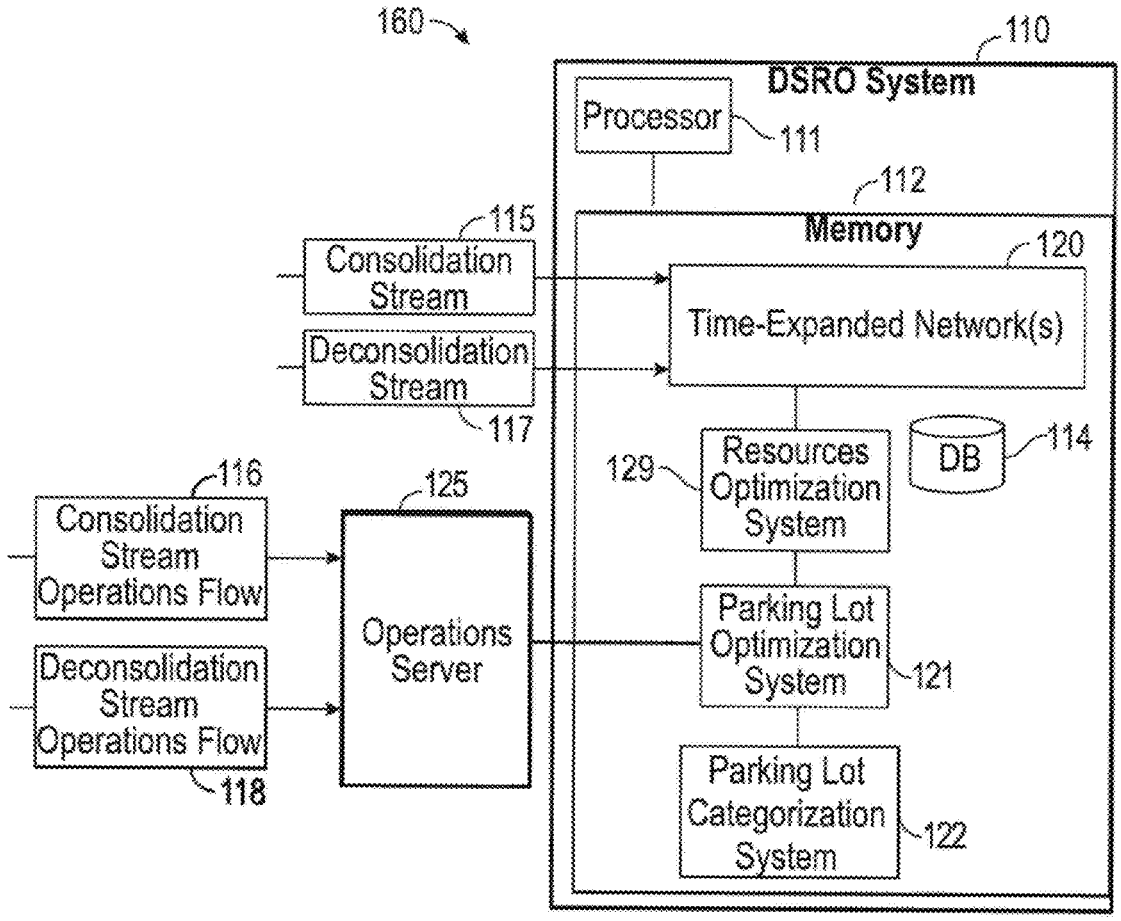
FIG. 2 is a block diagram illustrating an example of a DSRO system configured with capabilities and functionality for optimizing the utilization of parking lot resources of a hub based on a DSRO in accordance with embodiments of the present disclosure.

FIG. 2 is a block diagram illustrating an example of DSRO system 160 configured with capabilities and functionality for optimizing the utilization of parking lot resources of a hub based on a DSRO in accordance with embodiments of the present disclosure. As shown in FIG. 2, DSRO system 160 may be implemented in a server (e.g., server 110). In embodiments, functionality of server 110 to facilitate operations of DSRO system 160 may be provided by the cooperative operation of the various components of server 110, as will be described in more detail below.

It is noted that although FIG. 2 shows server 110 as a single server, it will be appreciated that server 110 (and the individual functional blocks of server 110) may be implemented as separate devices and/or may be distributed over multiple devices having their own processing resources, whose aggregate functionality may be configured to perform operations in accordance with the present disclosure. Furthermore, those of skill in the art would recognize that although FIG. 2 illustrates components of server 110 as single and separate blocks, each of the various components of server 110 may be a single component (e.g., a single application, server module, etc.), may be functional components of a same component, or the functionality may be distributed over multiple devices/components. In such embodiments, the functionality of each respective component may be aggregated from the functionality of multiple modules residing in a single, or in multiple devices. In addition, particular functionality described for a particular component of server 110 may actually be part of a different component of server 110, and as such, the description of the particular functionality described for the particular component of server 110 is for illustrative purposes and not limiting in any way.

As shown in FIG. 2, server 110 includes processor 111, memory 112, time-expanded network 120, parking lot optimization system 121, parking lot categorization system 122, resources optimization system 129, and database 114.

Processor 111 may comprise a processor, a microprocessor, a controller, a microcontroller, a plurality of microprocessors, an application-specific integrated circuit (ASIC), an application-specific standard product (ASSP), or any combination thereof, and may be configured to execute instructions to perform operations in accordance with the disclosure herein. In some embodiments, implementations of processor 111 may comprise code segments (e.g., software, firmware, and/or hardware logic) executable in hardware, such as a processor, to perform the tasks and functions described herein. In yet other embodiments, processor 111 may be implemented as a combination of hardware and software. Processor 111 may be communicatively coupled to memory 112.

Memory 112 may comprise one or more semiconductor memory devices, read only memory (ROM) devices, random access memory (RAM) devices, one or more hard disk drives (HDDs), flash memory devices, solid state drives (SSDs), erasable ROM (EROM), compact disk ROM (CD-ROM), optical disks, other devices configured to store data in a persistent or non-persistent state, network memory, cloud memory, local memory, or a combination of different memory devices. Memory 112 may comprise a processor readable medium configured to store one or more instruction sets (e.g., software, firmware, etc.) which, when executed by a processor (e.g., one or more processors of processor 111), perform tasks and functions as described herein.

Memory 112 may also be configured to facilitate storage operations. For example, memory 112 may comprise database 114 for storing various information related to operations of system 100. For example, database 114 may store configuration information related to operations of DSRO system 160. In embodiments, database 114 may store information related to various models used during operations of DSRO system 160, such as a DSRO model, a parking lot optimization model, a parking lot categorization model, etc. Database 114 is illustrated as integrated into memory 112, but in some embodiments, database 114 may be provided as a separate storage module or may be provided as a cloud-based storage module. Additionally, or alternatively, database 114 may be a single database, or may be a distributed database implemented over a plurality of database modules.

As mentioned above, operations of hub 140 may be represented as two distinct flows, an IG that may include a flow in which units arriving to hub 140 from customers are consolidated into outbound trains to be transported to their respective destinations, and an IB flow that may include a flow in which inbound trains arriving to hub 140 carrying units are deconsolidated into the units, which are stored in parking lots while waiting to be picked up by respective customers. DSRO system 160 may be configured to represent the IG flow of units as consolidation stream 115 including a plurality of stages. Each stage of consolidation stream 115 may represent different operations or events that may be performed or occur to facilitate the flow of the IG units through hub 140. DSRO system 160 may be configured to represent the IB flow of units as deconsolidation stream 117 including a plurality of stages. Each stage of deconsolidation stream 117 may represent different operations or events that may be performed or occur to facilitate the flow of the IB units through hub 140.

Each of the consolidation stream 115 and deconsolidation stream 117 may include various stages. For example, consolidation stream 115 may be configured to include a plurality of stages, namely an in-gated (IG) stage, an assignment (AS) stage, a ramping (RM) stage, a release (RL) stage, and a departure (TD) stage. Deconsolidation stream 115 may be configured to include a plurality of stages, namely an arrival (TA) stage, a strip track placement (ST-PU) stage, a de-ramping (DR) stage, a unit park and notification (PN) stage, and an out-gated (OG) stage. In embodiments, e ach of the stages of each of consolidation stream 115 and deconsolidation stream 117 may represent an event or operations that may be performed or occur to facilitate the flow of a unit through each of the streams.

In embodiments, the interaction between consolidation stream 115 and deconsolidation stream 117, with respect to the use of resources of hub 140, may be collaborative or competing. For example, parking spaces of parking lots 150 may be used to store units flowing through the AS stage of consolidation stream 115 while the units are waiting to be ramped (e.g., processed through the RM stage). However, parking spaces of parking lots 150 may also be used to store units processed through the DR stage of deconsolidation stream 117 (e.g., units unloaded from an inbound train), while these units are waiting to be picked up by a customer (e.g., while being processed through the PN stage). In this manner, consolidation stream 115 and deconsolidation stream 117 may compete for the use of parking lots 150 within hub 140.

In embodiments, DSRO system 160 may be configured to optimize the use of parking lot resources to maximize the throughput of the hub (e.g., the rate of units processed through the hub) by generating one or more time-space networks 120 to represent consolidation stream 115 and deconsolidation stream 117, and configuring the DSRO model to use one or more time-space networks 120, over a planning horizon, to optimize the use of the resources of the hub that support the unit flow within the planning horizon to maximize the throughput over the planning horizon. In embodiments, the DSRO model may generate, based on the one or more time-space networks 120, an optimized operating schedule that includes one or more of a determined unit flow through one or more of the stages of each time-space network (e.g., the consolidation and/or deconsolidation stream time-space networks) at each time increment of the planning horizon, an indication of a resource deficit or overage at one or more of the stages of each time-space network at each time increment of the planning horizon, and/or an indication or recommendation of a resource replenishment to be performed at one or more of the stages of each time-space network at each time increment of the planning horizon to ensure the optimized operating schedule is met. Particular to the present disclosure, the optimized operating schedule may include recommendations for parking lot allocation for units processed through each of the consolidation stream 115 and/or deconsolidation stream at each time increment of the planning horizon based on the classification of the units and/or the categories of each of parking lots 150.

In embodiments, DSRO system 160 may generate one or more time-space networks 120 using the stages of consolidation stream 115 and deconsolidation stream 117. In particular, DSRO system 160 may define the nodes of a time-space network to represent the stages of the corresponding stream, and the edges between the nodes to represent the capacity. The time increment of the time-space networks may be variable and configurable, and may represent, for example, a particular timeframe, such as an hour, a multi-hour block, a shift, etc. Although consolidation stream 115 and deconsolidation stream 117 may appear to operate independently, there is a resource interdependency between both streams that intertwines them at every stage. The DSRO model of embodiments may model not only both streams, but their resource interdependency and may leverage this configuration to optimize the resource utilization of both streams to maximize throughput over the planning horizon.

In embodiments, DSRO system 160 may be configured to apply the generated DSRO model to the time-expanded networks 120 to optimize the use of the resources (e.g., parking lot resources) by the consolidation and deconsolidation streams over the planning horizon to maximize throughput of the hub over the planning horizon. To that end, DSRO 160 may include a plurality of optimization systems. For example, resource optimization system 129 may be configured to generate, based on the DSRO model, an optimized operating schedule that may be implemented over a planning horizon to maximize throughput of units through the hub. In particular, resource optimization manager 129 may be configured to consider resource availability (e.g., resource inventory), resource replenishment cycles, resource cost, operational implications of inadequate supply of resources, for all the resources involved in the consolidation and deconsolidation streams to determine the optimized operating schedule that may maximize throughput through the hub over the planning horizon. Resource optimization manager 129 may be configured to additionally consider unit volumes (e.g., unit volumes expected to flow during the planning horizon through the consolidation stream and the deconsolidation streams, such as at each time increment of the planning horizon) and unit dwell times (e.g., expected dwell times of units flowing through the consolidation stream and the deconsolidation streams during the planning horizon) to determine the optimized operating schedule that may maximize throughput through the hub over the planning horizon In embodiments, the functionality of DSRO system 160 to optimize the utilization of parking lots 150 of hub 140 may include leveraging the functionality of parking lot optimization system 121. Parking lot optimization system 121 may operate to provide further optimization of hub operations by defining, refining, or otherwise determining parking lot allocation operations in an optimized manner, which may facilitate implementation of the optimized operating schedule.

For example, in embodiments, parking lot optimization system 121 may be configured to maximize the throughput of the parking lot spaces of parking lots 150 of hub 140 by optimizing the operating schedule such that, for each time increment of the planning horizon, parking lot categories are allocated for units expected to arrive during each of the time increment based on the expected dwell time of the arriving units and/or based on the parking lot categories. For example, for a first time increment within the planning horizon, an optimized operating schedule may expect a number of short-dwelling units and a number of long-dwelling units. In this example, parking lot optimization system 121 may further optimize the operating schedule by allocating, for the first time increment, a parking lot category (e.g., a high-priority parking lot) to the short-dwelling units and a parking lot category (e.g., a lower-priority parking lot) to the long-dwelling units, based on the parking lot capacity and/or expected available parking spaces. In this manner, parking lot optimization system 121 may be configured to maximize the throughput of the parking lot spaces of hub 140 by ensuring that short-dwelling units are assigned to parking spaces that are easily accessible, that medium-dwelling units to are assigned to parking spaces that are somewhat less accessible than the easily accessible parking spaces, and so on. In embodiments, parking lot optimization system 121 may consider the interaction between the consolidation stream time-space network and the deconsolidation stream time-space network, and the unit volume and dwell time composition of each stream while allocating the units to parking lots optimally.

In embodiments, parking lot optimization system 121 may cooperatively operate with parking lot categorization system 122, which may be configured to classify or categorize parking lots of parking lots 150 into different categories, depending, in some embodiments, on their proximity or accessibility to production tracks, their proximity or accessibility to hostler storage, their proximity or accessibility to the ingate (e.g., for customer pickup), etc. For example, some parking lots, by virtue of their relative position or access to the tracks, may be closer to the production tracks and may be better suited to have higher throughput (e.g., more turns) as units stored in these production tracks are more easily loaded onto a train. In another example, some parking lots may be closer or more accessible to hostlers, since hostler may only be required to drive short distances to these parking lots, which may give easier access to hostler drivers. In still other examples, some parking lots may be closer to the hub's ingate, which may mean that units stored in these parking lots may be more easily accessible for customers picking up these units. In this manner, the category of a parking lot, which may be based on the accessibility of the parking lot, may be useful when determining how accessible a unit stored in the parking lot is to be moved, which may impact the throughput of the parking lots. The parking lot categories may be used by the parking lot optimization system 121 to allocate parking lots to expected units at each time increment of the planning horizon of the optimized operating schedule.

In some embodiments, parking lot categorization system 122 may be configured to dynamically change the category of parking lots, such that the parking lot categories may not be static and may depend on various factors, such as capacity, expected unit traffic, environmental factors, etc. In some cases, the category of a parking lot may change from one time increment to another one, such that the parking lot may have a first category in a first time increment of the planning horizon and a second category in a second time increment of the planning horizon.

Figure 4:
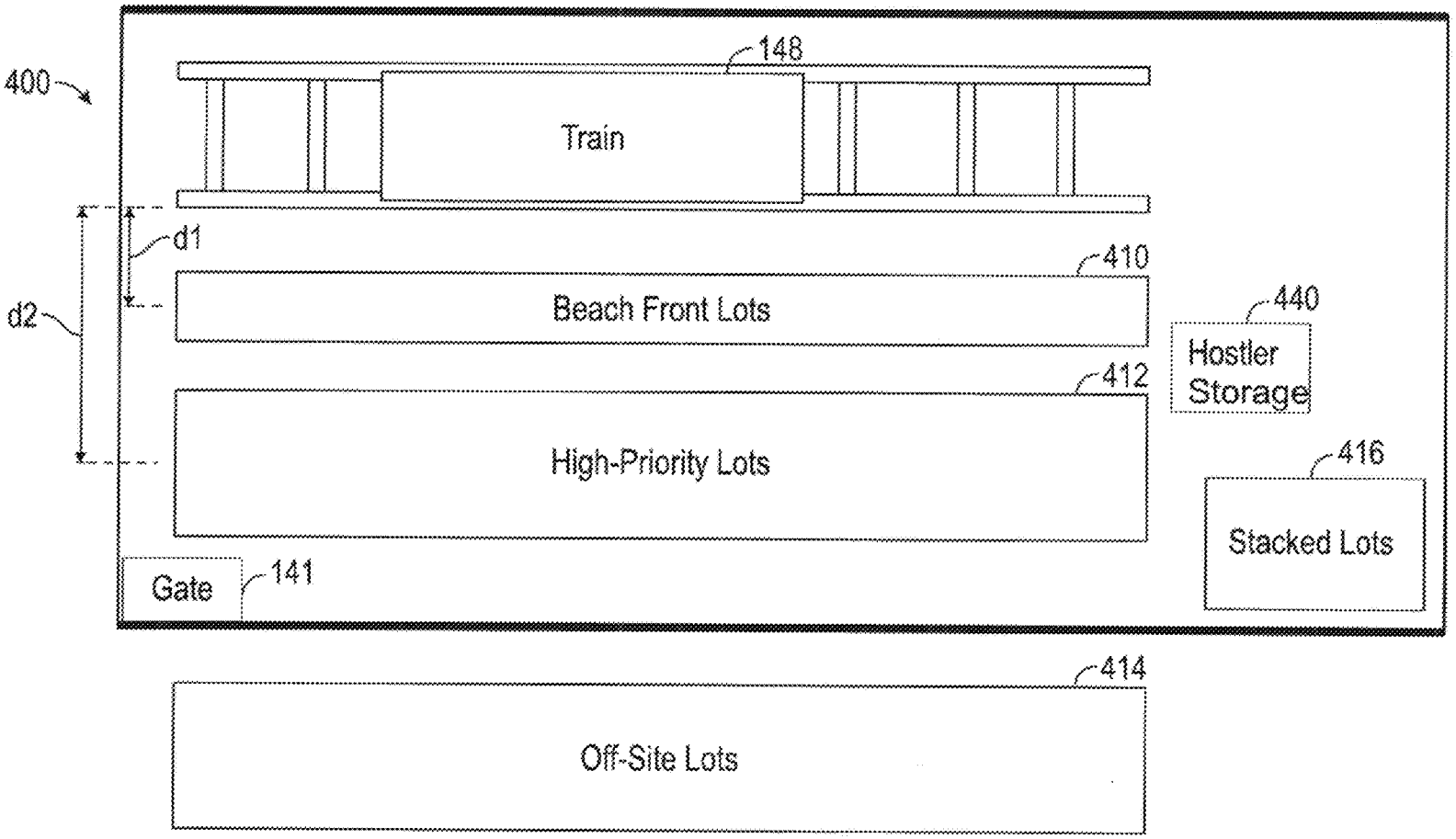
FIG. 4 is a block diagram of an exemplary configuration of parking lot categories of a hub configured with functionality for optimizing utilization of parking lots based on a DSRO in accordance with embodiments of the present disclosure.

FIG. 4 is a block diagram of an exemplary configuration 400 of parking lot categories of a hub configured with functionality for optimizing utilization of parking lots based on a DSRO in accordance with embodiments of the present disclosure. As can be seen in FIG. 4, hub 140 may include a plurality of parking lots, which may be laid out around hub 140 such that different ones of the parking lots may occupy different areas of hub 140. Hub 140 may also include production tracks 156, which may represent tracks on which a train (e.g., train 148) may be deconsolidated (e.g., when train 148 includes an inbound train arriving at hub 140) or consolidated (e.g., when train 148 represents an outbound train in which units may be transported to a destination). Hub 140 may also include hostler storage 440, which may include one or more locations where hostlers may be parked or stored. Hub 140 may also include gate 141 through which units brought by customers may arrive to hub 140 or through which units picked up by customers may exit hub 140.

In embodiments, the parking lots of hub 140 may be categorized or classified (e.g., using the functionality of parking lot categorization system 122) based on the configuration of the parking lots. For example, the parking lots may be categorized based on their proximity or accessibility to production tracks 156, their proximity or accessibility to hostler storage 440, their proximity or accessibility to gate 141, etc. In some embodiments, the desirability of a parking lot (e.g., the level of advantageousness of using a parking lot) may depend on the distance of the parking lot to production tracks 156. For example, parking lots may be categorized as trackside lots 410, since these parking lots may be closest to production tracks 156 (e.g., distance d1) providing parking spaces in this trackside lots 410 with easy access to production tracks 156 for ramping (e.g., loading units onto train 148) and/or de-ramping (e.g., unloading units onto train 148), as well as easy access to hostler storage 440 for moving the units into and out of the parking spaces of trackside lots 410. As production tracks 156 are closer to trackside lots 410 than to any other category of parking lots, units may be loaded/unloaded to/from train 148 more quickly using trackside lots 410, which may lead to more units being processed and lead to a higher throughput.

In another example, some parking lots may be categorized as hub lots 412. These hub lots 412 may be farther away from production tracks 156 than trackside lots 410 (e.g., distance d2>distance d1), and as such may provide less accessibility to production tracks 156 than trackside lots 410. It is noted that, with respect to hostler storage 440, hub lots 412 may have similar accessibility to hostler storage 440, although their longer distance from production tracks 156 may make these hub lots somewhat less desirable when it comes to ramping and de-ramping operations.

In still another example, some parking lots may be categorized as offsite lots 414. These offsite lots may be located outside of the boundary of hub 140, although may still be associated for operations of hub 140. As offsite lots 414 are located outside of physical boundary of hub 140, accessing these parking lots may provide less convenient than trackside lots 410 and hub lots 412, as hostlers may have to be driven a longer distance, taking up valuable time and resources, to access the parking spaces of offsite lots 414. As a result, at least with respect to ramping and de-ramping operations of hub 140, offsite lots 414 may be less desirable than trackside lots 410 and hub lots 412.

In another example, some parking lots may be categorized based on the configuration of the parking lots. For example, some parking lots of hub 140 may be categorized as stacked lots 416. Stacked lots 416 may include parking lots in which units parked or stored therein are stacked on top of each other, such that more than one unit may be parked, stored, or allocated to a single parking space. Stacked lots 416 may provide a higher storage capacity than a non-stacked parking lot, which may make these types of parking lots very desirable for long-dwelling units (since these long-dwelling units may remain within hub 140 for a very long period of time). However, stacked lots 416 have the disadvantage that removing a unit from a parking space, especially if the unit is in the bottom of a stack, may take significantly longer than if the unit was not stacked. As a result, stacked lots are typically the least desirable option for storing or parking units.

It is noted that the exemplary configuration shown in FIG. 4 and discussed herein is presented for illustrative purposes and not by way of limitation. Indeed, the present disclosure may apply to other parking lot configurations that may include different layouts, different categories, and/or different number of parking lots. As such, the present description with respect to FIG. 4 should not be construed as limiting in any way.

With reference back to FIG. 2, parking lot optimization system 121 may intake the parking lot categories of hub 140 to further optimize the optimized operating schedule by allocating parking lot categories to expected unit classifications at each time increment of the planning horizon of the optimized operating schedule. The classification of the units may include classifications based on the expected dwelling time of the units (e.g., short-dwelling, medium-dwelling, long-dwelling, etc.). For example, the optimized operating schedule may forecast that a particular number of short-dwelling units and a particular number of long-dwelling units may arrive at a first time increment of the planning horizon. The optimized operating schedule may forecast that another number of short-dwelling units and a particular number of medium-dwelling units may arrive at a second time increment of the planning horizon. In a similar manner, the optimized operating schedule may forecast a number of short-dwelling units, a number of medium-dwelling units, and/or a number of long-dwelling units that are to arrive at each time increment of the planning horizon. In embodiments, parking lot optimization system 121 may optimize the optimized operating schedule by allocating, for each time increment of the planning horizon, parking lot categories (e.g., parking lot spaces in parking lot categories) to meet the expected number and classification of units. For example, for the first time increment of the planning horizon, parking lot optimization system 121 may allocate sufficient parking spaces in a parking lot category to meet each of the number of short-dwelling units and long-dwelling units expected to arrive during the first time increment. Similarly, for the second time increment of the planning horizon, parking lot optimization system 121 may allocate sufficient parking spaces in a parking lot category to meet each of the another number of short-dwelling units and the number of medium-dwelling units expected to arrive during the second time increment. Operations of parking lot optimization system 121 will now be discussed with respect to FIG. 3.

Figure 3:
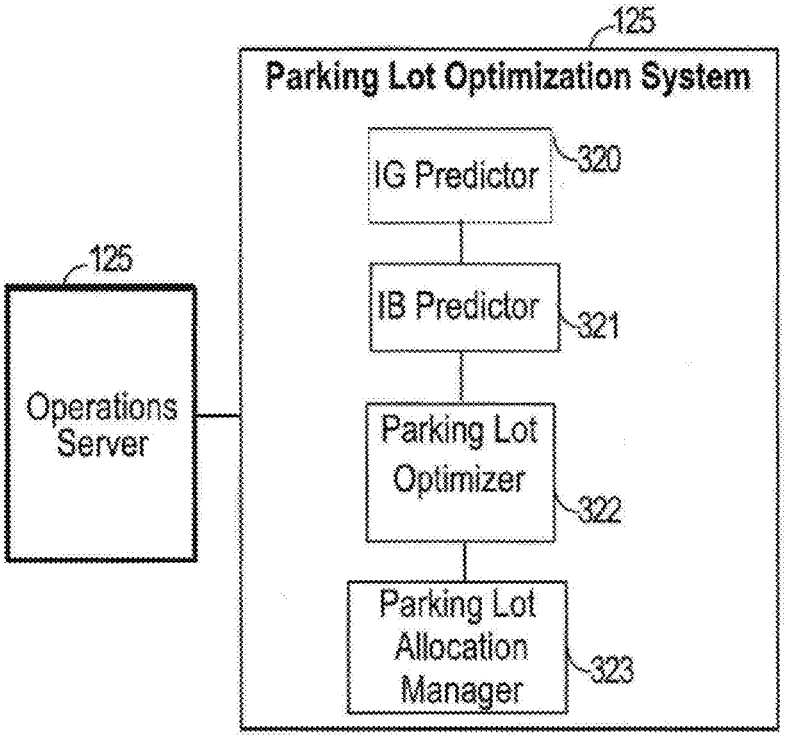
FIG. 3 is a block diagram of an exemplary parking lot optimization system configured with functionality for optimizing utilization of parking lots of a hub based on a DSRO in accordance with embodiments of the present disclosure.

FIG. 3 is a block diagram of an exemplary parking lot optimization system 121 configured with functionality for optimizing utilization of parking lots of a hub based on a DSRO in accordance with embodiments of the present disclosure. As shown in FIG. 3, parking lot optimization system 121 may include IG predictor 320, IB predictor 321, parking lot optimizer 322, and parking lot allocation manager 323.

IG predictor 320 may be configured to determine or predict the traffic flow through the consolidation stream over the planning horizon of the optimized operating schedule. IB predictor 321 may be configured to determine or predict the traffic flow through the deconsolidation stream over the planning horizon of the optimized operating schedule. In embodiments, determining the traffic flow through each stream (e.g., each of the consolidation stream and/or the deconsolidation stream) may include a determination as to the number of units (e.g., unit volume) expected at each time increment of the planning horizon over each of the stream, as well as the classification of the expected units (e.g., classification based on expected dwell time).

In embodiments, IG predictor 320 may be configured to determine the number and dwell time of units that may enter into the consolidation stream (e.g., at each time increment of the planning horizon). However, it is noted that the number of units that may enter into the consolidation stream at each time increment of the planning horizon may not be known, as the number of units that may enter into the consolidation stream may depend on customer demand, which may vary widely, may be seasonal, cyclical, or even uniform. In embodiments, IG predictor 320 may be configured with an IG volume model configured to predict the unknown number of units that may enter into the consolidation stream (e.g., at each time increment of the planning horizon). The IG volume model may predict the number of units to be in-gated using information from operations server 125, such as including shipper, size of the unit, destination, priority, and service level for a particular timeframe. In embodiments, the prediction may include unit volume by time increments (e.g., by hourly, daily, etc. increments).

On the other hand, the dwell time of units entering the consolidation stream at each time increment of the planning horizon may be known, as these units may be configured with a "goal time" (e.g., a date/time at which the unit should be delivered at the destination), and the length of time that the unit may spend within the hub may be computed from the goal time. In addition, operations server 125 may include information such as train schedules, etc., which may be used to "pair" expected IG units with an outbound train, which may allow IG predictor 320 to compute dwell times for the expected IG units from this information with great accuracy. Indeed, in some embodiments, the hub operator may set the dwell time of each unit entering the consolidation stream over the planning horizon, as the hub operator may know the operating train scheduled during the planning horizon, which may allow the train operator to assign the arriving units to respective trains and, in this manner, set the dwell time of the units.

In embodiments, IG predictor 320 may determine a number of units expected to arrive for each dwell time classification. For example, for each unit expected to arrive in the consolidation stream during each time increment of the planning horizon, IG predictor 320 may determine a classification of the units based on the dwell time of the unit. In another example, IG predictor 320 may determine a number of units in each dwell time classification expected to arrive at each time increment of the planning horizon. In embodiments, the dwell time classifications may include a plurality of classifications based on the expected dwell of the units.

The dwell time classifications may include, without limitation, a short-dwelling classification, a medium-dwelling classification, a long-dwelling classification, an extremely long-dwelling classification, etc. In some embodiments, the number of dwell time classification may vary and may depend on DSRO system 160 configuration. In some embodiments, other dwell time classifications may be used. In some embodiments, a short-dwell time classification may be used for units with an expected dwell time less than a medium-dwell time classification, a medium-dwell time classification may be used for units with an expected dwell time less than a long-dwell time classification, and a long-dwell time classification may be used for units with an expected dwell time less than an extremely long-dwell time classification. In a particular example, a short-dwell time classification may be used for units with an expected dwell time that is less than 8 hours, a medium-dwell time classification may be used for units with an expected dwell time that is between 8 and 16 hours, a long-dwell time classification may be used for units with an expected dwell time that is between 16 and 24 hours, and an extremely long-dwell time classification may be used for units with an expected dwell time that is greater than 24 hours.

It is noted that these specific examples of dwell time classifications provided herein are provided for illustrative purposes and should not be construed as limiting in any way. Indeed, other values and ranges may be used for the dwell time classification as determined by operational requirements or designs.

In embodiments, IB predictor 321 may be configured to determine the number and dwell time of units that may enter into the deconsolidation stream (e.g., at each time increment of the planning horizon). In embodiments, the number of units that may enter into the deconsolidation stream at each time increment of the planning horizon may be known. For example, information on inbound trains may be scheduled to arrive at the hub, and the number of units being carried by these trains may be known to operations server 125 and thus known to IB predictor 321. If a train is not built at the origination of a unit, but is scheduled to be initiated, built, and scheduled to arrive within the planning horizon, the historical averages (e.g., from operations server 125) may be used to determine the unit count being carried by that train particular train.

On the other hand, the dwell time of units that may enter the deconsolidation stream at each time increment of the planning horizon may not be known, as the dwell time of deconsolidated units may depend on when the customer picks these units up, which is an unknown value. For example, once a unit arrives at the hub and enters the deconsolidation stream, it may be up to the customer to come and pick it up from the hub. The dwell time of the unit then is determined by the customer, and so it may be unknown to IB predictor 321.

In embodiments, IB predictor 321 may be configured with a dwell time prediction model configured to predict the unknown dwell time of the units processed through the deconsolidation stream (e.g., at each time increment of the planning horizon). The dwell time prediction model may be configured to use a large set of details pertinent to each unit and may predict the individual dwell time of each unit expected to enter the deconsolidation stream at each time increment of the planning horizon. In embodiments, IB predictor 321 may classify the predicted dwell durations into a fixed set of bands (e.g., ranges) and may map these ranges to dwell time classifications. For example, for each unit expected to arrive in the deconsolidation stream during each time increment of the planning horizon, IB predictor 321 may determine a classification of the units based on the predicted dwell time of the unit. In another example, IB predictor 321 may determine a number of units in each dwell time classification predicted to arrive in the deconsolidation stream at each time increment of the planning horizon. In embodiments, the dwell time classifications may include a plurality of classifications based on the predicted dwell of the units, which may include, in some examples, a short-dwelling classification, a medium-dwelling classification, a long-dwelling classification, an extremely long-dwelling classification, etc.

Parking lot optimizer 322 may be configured to optimize parking lot allocations for the optimized operating schedule over the planning horizon. In embodiments, parking lot optimizer 322 may be configured to determine, based on the optimized operating schedule, and the predictions by IG predictor 320 and IB predictor 321, parking lot allocations to ensure that throughput is maximized over the planning horizon. In embodiments, parking lot optimizer 322 may assess current levels of resources available at the hub, as well as total resource capacity of the hub, and determines a parking allocation scheme that takes into account the resources availability and capacity to ensure throughput is maximized over the planning horizon. In particular embodiments, parking lot optimizer 322 may determine current availability and total capacity of parking lot resources, as well as the category of each parking lot available (e.g., based on cooperative operation with parking lot categorization system 122 as described herein) to determine allocation of parking lot category capacity to each time increment of the planning horizon to ensure that units expected to arrive at the hub during each time increment are assigned to a parking lot with the best possible category without being displaced by a unit with longer dwell time. For example, the functionality of parking lot optimizer 322 may operate to allocate parking lots to ensure that, over the planning horizon, units with a shorter dwell time are not displaced from a parking lot with a higher classification by longer dwelling units. For example, the functionality of parking lot optimizer 322 may ensure that a short-dwelling unit arriving at the hub at a particular time increment of the planning horizon is not displaced by a medium-dwelling or long-dwelling or extremely long-dwelling unit from a more desirable parking lot. In this example, the short-dwelling unit may not be displaced from a trackside lot by a longer-dwelling unit. In this example, the short-dwelling unit may be displaced from a trackside lot by another short-dwelling unit, but not by a longer-dwelling unit. In this case, no longer-dwelling unit should be assigned to a higher-priority parking lot (e.g., a parking lot with a more desirable configuration) while a shorter-dwelling unit is assigned to a lower-priority parking lot. For example, no longer-dwelling unit should be assigned to a trackside lot while a shorter-dwelling unit is assigned to a hub lot, an offsite lot, or a stacked lot. By ensuring that that units with a shorter dwell time are not displaced from a parking lot with a higher classification by longer dwelling units over the planning horizon, parking lot optimizer 322 may ensure that parking lot throughput is maximized over the planning horizon.

In some embodiments, the functionality of parking lot optimizer 322 to allocate parking lots may include allocating the highest parking lot category available to units based on current parking lot resource inventory and predicted parking lot resource consumption, based on unit traffic volume expected during the planning horizon. For example, a medium-dwelling unit may be expected to arrive at a first time increment of the planning horizon, and a short-dwelling unit is expected to arrive at a second time increment that is within the medium-dwell time duration. In this example, a hub lot may be allocated to the first time increment of the planning horizon (e.g., to be assigned to the medium-dwelling unit expected to arrive at the first time increment) even though the trackside lot is available during the first time increment due to the short-dwelling unit expected to arrive at the second time increment that is within the medium-dwell time duration. In this case, the trackside lot may be allocated to the second time increment so that the short-dwelling unit may be assigned to the trackside lot when it arrives during the second time increment. It is noted that, were the trackside lot not allocated to the second time increment and instead were allocated to the first time increment since it may be predicted to be available during the first time increment (e.g., as some typical parking lot allocation systems operate), the short-dwelling unit would not be able to be assigned to the trackside lot during the second time increment, causing the short-dwelling unit to be displaced from the trackside lot by the medium-dwelling unit, which would not be an optimized result.

In another example, a medium-dwelling unit may be expected to arrive at a first time increment of the planning horizon, and no shorter-dwelling unit is expected to arrive within the duration of the medium-dwell time. In this example, parking lot optimizer 322 may determine to allocate a trackside lot that is available at the first time increment, since no shorter-dwelling unit may be displaced from the trackside lot by the medium-dwelling unit.

Parking lot allocation manager 323 may be configured to manage the parking lot allocations determined by parking lot optimizer 322. In particular, parking lot allocation manager 323 may be configured to modify the optimized operating schedule generated by resource optimization system 129 to include recommendations associated with the optimized parking allocations determined by parking lot optimizer 322. The optimized operating schedule including the optimized parking allocations may be provided to operations server 125 to be executed during the planning horizon.

In some embodiments, during execution of the optimized operating schedule over the planning horizon, parking lot allocation manager 323 may perform the parking lot allocations at each time increment. For example, as units arrive at the hub at various time increments, operations server may request parking allocations from parking lot allocation manager 323 for the units. In embodiments, the parking allocation request may include an indication of the dwell time classification of the units for which the parking allocation is being requested. For example, operations server 125 may determine a dwell time classification of a unit based on characteristics of the units, such as based on a dwell time prediction model (e.g., for units arriving through the deconsolidation stream) and/or based on active train schedule, goal time, etc. (e.g., for units arriving through the consolidation stream). In embodiments, parking lot allocation manager 323 may assign the units to a parking lot category based on the classification of the units in accordance with the optimized parking allocations of the optimized operating schedule. For example, for a unit arriving at a particular time increment and classified with a particular dwell time classification, a parking allocation recommendation may be included in the optimized operating schedule that may be used by the parking lot allocation manager 323 to assign the unit to a parking lot. For example, the unit may be classified as a short-dwelling unit and the optimized operating schedule may include a parking lot allocation recommendation that includes a trackside lot allocation for a short-dwelling unit arriving at the time increment. In this case, the short-dwelling unit may be assigned to a trackside lot. In another example, the unit may be classified as a medium-dwelling unit and the optimized operating schedule may include a parking lot allocation recommendation that includes a trackside lot allocation for a medium-dwelling unit arriving at the time increment. In this case, the medium-dwelling unit may be assigned to a trackside lot. In yet another example, the unit may be classified as a medium-dwelling unit and the optimized operating schedule may include a parking lot allocation recommendation that includes a hub lot allocation for a medium-dwelling unit arriving at the time increment. In this case, the medium-dwelling unit may be assigned to a hub lot. In yet another example, In embodiments, during execution of the optimized operating schedule over the planning horizon, parking lot allocation manager 323 may update the optimized parking allocations based on actual unit traffic. For example, during execution of the optimized operating schedule, unit traffic (e.g., consolidation stream traffic and deconsolidation stream traffic) may flow through the hub, and may be captured by operations server 125. The actual unit traffic flowing through the hub may be the same as the traffic flow predicted by the optimized operating schedule, or may differ from the predictions in the optimized operating schedule. For example, the number and/or the dwell time of units (e.g., unit volume) arriving at the hub (e.g., flowing through the consolidation stream and/or deconsolidation stream) may be the same as expected according to the optimized operating schedule or may be different from the number and/or the dwell time of units expected according to the optimized operating schedule. When the actual unit traffic is the same as expected, the recommended parking lot allocations may remain the same. However, when the actual unit traffic is different from the expected unit traffic, parking lot allocation manager (e.g., in cooperation with IG predictor 320, IB predictor 321, and/or parking lot optimizer 322) may update the parking lot allocation recommendations based on the actual unit traffic.

Figure 5:
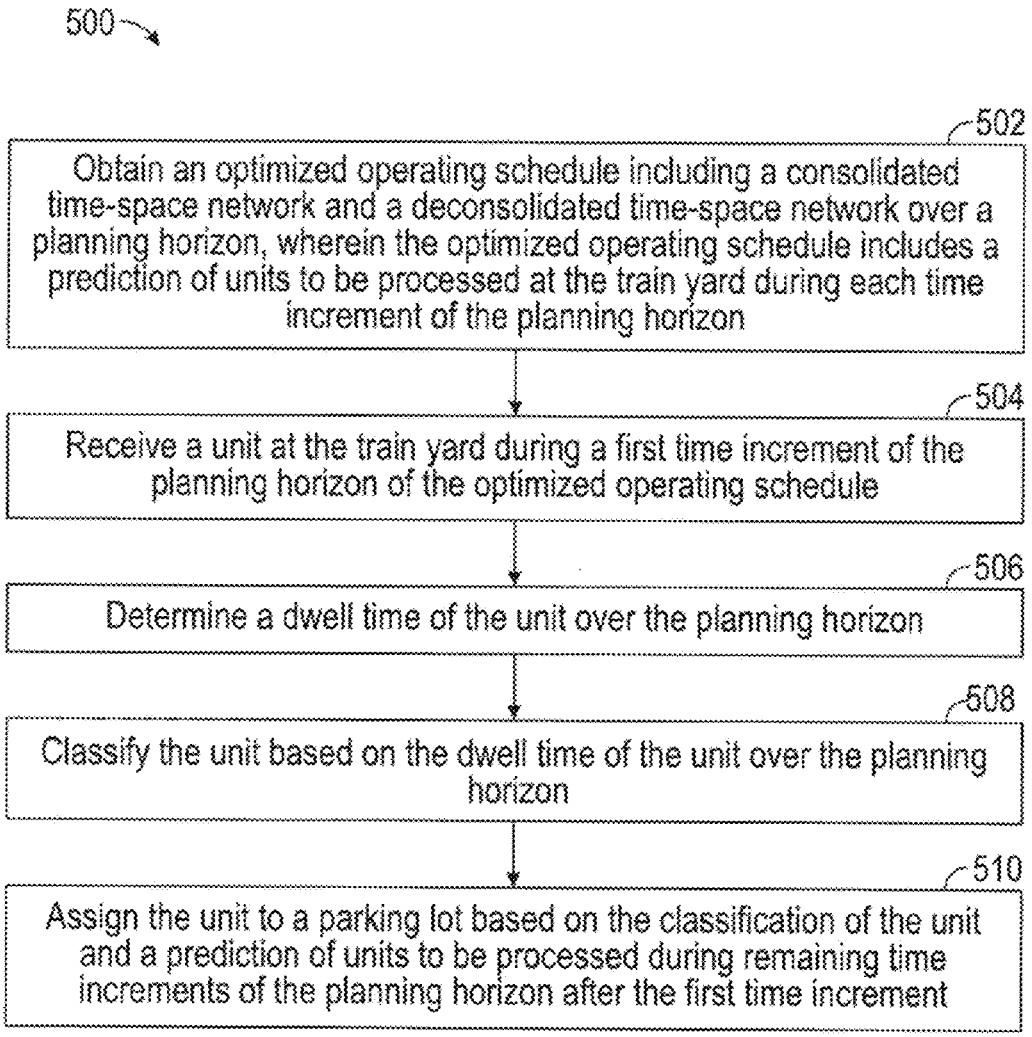
FIG. 5 shows a high-level flow diagram of operations of a system for providing functionality for optimizing utilization of parking lots of a hub based on a DSRO in accordance with embodiments of the present disclosure.

FIG. 5 shows a high-level flow diagram 500 of operation of a system configured for providing functionality for optimizing utilization of parking lots associated with a hub in accordance with embodiments of the present disclosure. For example, the functions illustrated in the example blocks shown in FIG. 5 may be performed by system 100 of FIG. 1 according to embodiments herein. In embodiments, the operations of the method 500 may be stored as instructions that, when executed by one or more processors, cause the one or more processors to perform the operations of the method 600.

At block 502, an optimized operating schedule including a consolidated time-space network and a deconsolidated time-space network over a planning horizon is obtained. In embodiments, the optimized operating schedule includes a prediction of units to be processed at the hub during each time increment of the planning horizon. In embodiments, functionality of a resource optimization system (e.g., resource optimization system 129 as illustrated in FIG. 2) may be used to obtain an optimized operating schedule including a consolidated time-space network and a deconsolidated time-space network over a planning horizon. In embodiments, the resource optimization system may perform operations to obtain an optimized operating schedule including a consolidated time-space network and a deconsolidated time-space network over a planning horizon according to operations and functionality as described above with reference to resource optimization system 129 and as illustrated in FIGS. 1-4.

At block 504, a unit is received at the hub during a first time increment of the planning horizon of the optimized operating schedule. In embodiments, functionality of an operations server (e.g., operations server 125 as illustrated in FIGS. 2 and 3) may be used to receive a unit at the hub during a first time increment of the planning horizon of the optimized operating schedule. In embodiments, the operations server may perform operations to receive a unit at the hub during a first time increment of the planning horizon of the optimized operating schedule according to operations and functionality as described above with reference to operations server 125 and as illustrated in FIGS. 1-4.

At block 506, a dwell time of the unit over the planning horizon is determined. In embodiments, functionality of an operations server (e.g., operations server 125 as illustrated in FIGS. 2 and 3) may be used to determine a dwell time of the unit over the planning horizon. In embodiments, the operations server may perform operations to determine a dwell time of the unit over the planning horizon according to operations and functionality as described above with reference to operations server 125 and as illustrated in FIGS. 1-4.

At block 508, classify the unit based on the dwell time of the unit over the planning horizon. In embodiments, functionality of an operations server (e.g., operations server 125 as illustrated in FIGS. 2 and 3) may be used to classify the unit based on the dwell time of the unit over the planning horizon. In embodiments, the operations server may perform operations to classify the unit based on the dwell time of the unit over the planning horizon according to operations and functionality as described above with reference to operations server 125 and as illustrated in FIGS. 1-4.

At block 510, the unit is assigned to a parking lot associated with the hub based on the classification of the unit and a prediction of units to be processed during remaining time increments of the planning horizon after the first time increment. In embodiments, functionality of a parking lot optimization system (e.g., parking lot optimization system 121 as illustrated in FIGS. 2 and 3) may be used to assign the unit to a parking lot associated with the hub based on the classification of the unit and a prediction of units to be processed during remaining time increments of the planning horizon after the first time increment. In embodiments, the parking lot optimization system may perform operations to assign the unit to a parking lot associated with the hub based on the classification of the unit and a prediction of units to be processed during remaining time increments of the planning horizon after the first time increment according to operations and functionality as described above with reference to parking lot optimization system 121 and as illustrated in FIGS. 1-4.

Persons skilled in the art will readily understand that advantages and objectives described above would not be possible without the particular combination of computer hardware and other structural components and mechanisms assembled in this inventive system and described herein. Additionally, the algorithms, methods, and processes disclosed herein improve and transform any general-purpose computer or processor disclosed in this specification and drawings into a special purpose computer programmed to perform the disclosed algorithms, methods, and processes to achieve the aforementioned functionality, advantages, and objectives. It will be further understood that a variety of programming tools, known to persons skilled in the art, are available for generating and implementing the features and operations described in the foregoing. Moreover, the particular choice of programming tool(s) may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosure can be established by the appended claims. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

Those of skill in the art would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. Skilled artisans will also readily recognize that the order or combination of components, methods, or interactions that are described herein are merely examples and that the components, methods, or interactions of the various embodiments of the present disclosure may be combined or performed in ways other than those illustrated and described herein.

Functional blocks and modules in FIGS. 1-6 may comprise processors, electronics devices, hardware devices, electronics components, logical circuits, memories, software codes, firmware codes, etc., or any combination thereof. Consistent with the foregoing, various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal, base station, a sensor, or any other communication device. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. Computer-readable storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, a connection may be properly termed a computer-readable medium. For example, if the software is transmitted from a website, server, or other remote source using a coaxial cable, fiber optic cable, twisted pair, or digital subscriber line (DSL), then the coaxial cable, fiber optic cable, twisted pair, or DSL, are included in the definition of medium. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method of optimizing utilization of parking lots associated with a hub by a computing system, the computing system including one or more processors configured to execute computer program instructions, comprising:

spawning a first computer process configured to execute a first subset of a set of computer program instructions configured to implement at least a portion of steps of the method of optimizing utilization of parking lots associated with a hub;

spawning a second computer process configured to execute a second subset of the set of computer program instructions configured to implement at least a portion of steps of the method of optimizing utilization of parking lots associated with a hub, wherein the first computer process and the second computer process are spawned concurrently and the first and second subset of the set of computer program instructions are executed in parallel, wherein a combination of the first subset and the second subset of computer program instructions is configured to concurrently process data to perform the steps of the method of optimizing utilization of parking lots associated with a hub;

obtaining an optimized operating schedule including a consolidated time-space network and a deconsolidated time-space network over a planning horizon, wherein the optimized operating schedule includes a prediction of units to be processed at the hub during each time increment of the planning horizon;

receiving a unit at the hub during a first time increment of the planning horizon of the optimized operating schedule;

determining a dwell time of the unit over the planning horizon;

classifying the unit based on the dwell time of the unit over the planning horizon; and assigning the unit to a parking lot associated with the hub based on the classification of the unit and a prediction of units to be processed during remaining time increments of the planning horizon after the first time increment, wherein the parking lot associated with the hub includes one or more of:

trackside parking lots including parking lots within a first distance of a ramping or deramping track;

hub parking lots including parking lots within a second distance of the ramping or deramping track, the second distance greater than the first distance;

off-site parking lots including parking lots outside of the hub; and stacked parking lots including parking lots with units stacked over each other.

2. The method of claim 1, wherein the prediction of units to be processed at the hub during each time increment of the planning horizon includes a prediction of units to flow through a consolidation stream associated with the consolidated time-space network during each time increment of the planning horizon.

3. The method of claim 2, wherein the unit received at the hub is to flow through the consolidation stream; and wherein determining the dwell time of the unit over the planning horizon includes determining the dwell time of the unit over the planning horizon based on a unit-to-train assignment system configured to assign the unit to a train based on a known train schedule.

4. The method of claim 1, wherein the prediction of units to be processed at the hub during each time increment of the planning horizon includes a prediction of units to flow through a deconsolidation stream associated with the deconsolidated time-space network during each time increment of the planning horizon.

5. The method of claim 4, wherein the unit received at the hub is to flow through the deconsolidation stream; and wherein determining the dwell time of the unit over the planning horizon includes predicting the dwell time of the unit over the planning horizon using a dwell time prediction model.

6. The method of claim 1, wherein classifying the unit based on the dwell time of the unit over the planning horizon includes classifying the unit into one of:

a short dwell time unit when the dwell time of the unit over the planning horizon is determined to be less than a first threshold;

a medium dwell time unit when the dwell time of the unit over the planning horizon is determined to be equal to or more than the first threshold and less than a second threshold;

a long dwell time unit when the dwell time of the unit over the planning horizon is determined to be equal to or more than the second threshold and less than a third threshold;

a prediction of extremely long dwell time units to be processed at the hub during the time increment; and an extremely long dwell time unit when the dwell time of the unit over the planning horizon is determined to be equal to or more than the third threshold and less than a fourth threshold.

7. The method of claim 6, wherein the prediction of units to be processed at the hub during a time increment of the planning horizon includes one or more of:

a prediction of short dwell time units to be processed at the hub during the time increment;

a prediction of medium dwell time units to be processed at the hub during the time increment; and a prediction of long dwell time units to be processed at the hub during the time increment.

8. The method of claim 1, wherein assigning the unit to a parking lot associated with the hub is further based on a number of available spaces in the parking lot.

9. The method of claim 1, wherein assigning the unit to a parking lot associated with the hub includes:

assigning the unit to a highest priority parking lot available based on parking lot spaces currently available at the highest priority parking lot and parking lot spaces available based on a number of higher-priority units predicted to be processed during the remaining time increments of the planning horizon after the first time increment.

10. A system configured to optimize utilization of resources in a train yard, comprising:

at least one processor configured to execute computer program instructions; and a memory operably coupled to the at least one processor and storing the computer program instructions, wherein the configuration of the at least one processor to execute the computer program instructions includes configuration to spawn a first computer process configured to execute a first computer process configured to execute a first subset of a set of computer program instructions and to spawn second computer process configured to execute a second subset of the set of computer program instructions, wherein the first computer process and the second computer process are spawned concurrently and the first and second subset of the set of computer program instructions are executed in parallel, wherein a combination of the first subset and the second subset of computer program instructions is configured to concurrently process data to perform operations including:

obtaining an optimized operating schedule including a consolidated time-space network and a deconsolidated time-space network over a planning horizon, wherein the optimized operating schedule includes a prediction of units to be processed at the hub during each time increment of the planning horizon;

receiving a unit at the hub during a first time increment of the planning horizon of the optimized operating schedule;

determining a dwell time of the unit over the planning horizon;

classifying the unit based on the dwell time of the unit over the planning horizon; and assigning the unit to a parking lot associated with the hub based on the classification of the unit and a prediction of units to be processed during remaining time increments of the planning horizon after the first time increment, wherein the parking lot associated with the hub includes one or more of:

trackside parking lots including parking lots within a first distance of a ramping or deramping track;

hub parking lots including parking lots within a second distance of the ramping or deramping track, the second distance greater than the first distance;

off-site parking lots including parking lots outside of the hub; and stacked parking lots including parking lots with units stacked over each other.

11. The system of claim 10, wherein the prediction of units to be processed at the hub during each time increment of the planning horizon includes a prediction of units to flow through a consolidation stream associated with the consolidated time-space network during each time increment of the planning horizon.

12. The system of claim 11, wherein the unit received at the hub is to flow through the consolidation stream; and wherein determining the dwell time of the unit over the planning horizon includes determining the dwell time of the unit over the planning horizon based on a unit-to-train assignment system configured to assign the unit to a train based on a known train schedule.

13. The system of claim 10, wherein the prediction of units to be processed at the hub during each time increment of the planning horizon includes a prediction of units to flow through a deconsolidation stream associated with the deconsolidated time-space network during each time increment of the planning horizon.

14. The system of claim 13, wherein the unit received at the hub is to flow through the deconsolidation stream; and wherein determining the dwell time of the unit over the planning horizon includes predicting the dwell time of the unit over the planning horizon using a dwell time prediction model.

15. The system of claim 10, wherein classifying the unit based on the dwell time of the unit over the planning horizon includes classifying the unit into one of:

a short dwell time unit when the dwell time of the unit over the planning horizon is determined to be less than a first threshold;

a medium dwell time unit when the dwell time of the unit over the planning horizon is determined to be equal to or more than the first threshold and less than a second threshold;

a long dwell time unit when the dwell time of the unit over the planning horizon is determined to be equal to or more than the second threshold and less than a third threshold; and an extremely long dwell time unit when the dwell time of the unit over the planning horizon is determined to be equal to or more than the third threshold and less than a fourth threshold.

16. The system of claim 15, wherein the prediction of units to be processed at the hub during a time increment of the planning horizon includes one or more of:

a prediction of short dwell time units to be processed at the hub during the time increment;

a prediction of medium dwell time units to be processed at the hub during the time increment;

a prediction of long dwell time units to be processed at the hub during the time increment; and a prediction of extremely long dwell time units to be processed at the hub during the time increment.

17. The system of claim 10, wherein assigning the unit to a parking lot associated with the hub includes:

assigning the unit to a highest priority parking lot available based on parking lot spaces currently available at the highest priority parking lot and parking lot spaces available based on a number of higher-priority units predicted to be processed during the remaining time increments of the planning horizon after the first time increment.

18. A computer-based tool for optimizing utilization of resources in a train yard, the computer-based tool including non-transitory computer readable media having stored thereon computer code which, when executed by a processor, causes a computing device to spawn a first computer process configured to execute a first subset of a set of computer program instructions of the computer code and to spawn second computer process configured to execute a second subset of the set of computer program instructions of the computer code, wherein the first computer process and the second computer process are spawned concurrently and the first and second subset of the set of computer program instructions are executed in parallel, wherein a combination of the first subset and the second subset of computer program instructions is configured to concurrently process data to perform operations comprising:

obtaining an optimized operating schedule including a consolidated time-space network and a deconsolidated time-space network over a planning horizon, wherein the optimized operating schedule includes a prediction of units to be processed at the hub during each time increment of the planning horizon;

receiving a unit at the hub during a first time increment of the planning horizon of the optimized operating schedule;

determining a dwell time of the unit over the planning horizon;

classifying the unit based on the dwell time of the unit over the planning horizon; and assigning the unit to a parking lot associated with the hub based on the classification of the unit and a prediction of units to be processed during remaining time increments of the planning horizon after the first time increment, wherein the parking lot associated with the hub includes one or more of:

trackside parking lots including parking lots within a first distance of a ramping or deramping track;

hub parking lots including parking lots within a second distance of the ramping or deramping track, the second distance greater than the first distance;

off-site parking lots including parking lots outside of the hub; and stacked parking lots including parking lots with units stacked over each other.

* * * * *